US007128187B2

(12) United States Patent
Simpson

(10) Patent No.: US 7,128,187 B2
(45) Date of Patent: Oct. 31, 2006

(54) STEPLADDER WITH PIVOTING UTILITY TRAY

(75) Inventor: Dennis Simpson, Minnetonka, MN (US)

(73) Assignee: Tricam Industries, Inc., Eden Prairie, MN (US)

( * ) Notice: Subject to any disclaimer, the term of this patent is extended or adjusted under 35 U.S.C. 154(b) by 495 days.

(21) Appl. No.: 10/390,550

(22) Filed: Mar. 17, 2003

(65) Prior Publication Data

US 2004/0007424 A1 Jan. 15, 2004

Related U.S. Application Data

(60) Provisional application No. 60/364,893, filed on Mar. 15, 2002.

(51) Int. Cl.
*E06C 1/00* (2006.01)

(52) U.S. Cl. ..... 182/129; 182/165

(58) Field of Classification Search ..... 182/165, 182/129

See application file for complete search history.

(56) References Cited

U.S. PATENT DOCUMENTS

| | | | | |
|---|---|---|---|---|
| 749,670 | A * | 1/1904 | Gardner | 248/242 |
| 3,625,388 | A | 12/1971 | Golden | |
| 3,744,591 | A | 7/1973 | Lucci | |
| 4,276,955 | A | 7/1981 | Hickman | |
| 4,502,564 | A | 3/1985 | Kummerlin et al. | |
| 5,052,581 | A | 10/1991 | Christ | |
| 5,137,240 | A * | 8/1992 | Van Meter | 248/292.14 |
| 5,613,574 | A | 3/1997 | Melanson | |
| 5,673,885 | A | 10/1997 | Pham | |
| 5,722,507 | A * | 3/1998 | Kain | 182/129 |
| 6,443,260 | B1 | 9/2002 | Katz | |
| 6,622,340 | B1 | 9/2003 | Rosa | |
| 2002/0017430 | A1 * | 2/2002 | Rosko | 182/129 |

FOREIGN PATENT DOCUMENTS

| | | | |
|---|---|---|---|
| DE | 3320315 | A1 * | 12/1984 |
| FR | 2554501 | A1 * | 5/1985 |
| GB | 2175948 | A * | 12/1986 |

* cited by examiner

*Primary Examiner*—Alvin Chin-Shue
(74) *Attorney, Agent, or Firm*—Patterson, Thuente, Skaar, Christensen, P.A.

(57) ABSTRACT

A stepladder that includes a first frame, a second frame, a step, a utility tray and a support arm. The second frame is pivotally attached to the first frame. The step is operably connected to the first frame and the second frame. The step pivots with respect to at least one of the first frame and the second frame as the first frame is pivoted with respect to the second frame. The utility tray is pivotally connected to the second frame and includes a top panel and a side panel. The top panel has a first end and a second end. The side panel extends from the top panel along a side of the top panel that extends between the first end and the second end. The side panel has a slot formed therein. The side panel has a detent formed therein. The detent is in communication with the slot. The support arm has a first end and a second end. The first end of the support arm is pivotally connected to the second frame. The second end of the support arm is slidable with respect to the slot to pivot the utility tray from a raised position to a lowered position.

26 Claims, 4 Drawing Sheets

STEPLADDER WITH PIVOTING UTILITY TRAY

REFERENCE TO RELATED APPLICATION

The present application claims the benefit of U.S. Provisional Patent Applic. No. 60/364,893, filed on Mar. 15, 2002, which is hereby incorporated by reference.

FIELD OF THE INVENTION

The present invention relates generally to a stepladder. More particularly, the present invention relates to a stepladder with a pivoting utility tray.

BACKGROUND OF THE INVENTION

Stepladders are generally known in the art. Kummerlin, U.S. Pat. No. 4,502,564, discloses a foldable stepladder. Because of their desired portability, foldable stepladders often include handles and other features that make them easier to transport. Lucci, U.S. Pat. No. 3,744,591, discloses a portable, folding stepladder.

When working on a stepladder, it is often desirable to have tools, paint and other necessary objects within easy reach. For example, it is known to removably attach a paint roller tray to the rung of a ladder to more easily paint a ceiling or other area requiring a ladder or step stool. Golden, U.S. Pat. No. 3,625,388, discloses a paint tray particularly useful with an upright ladder.

Utility trays for use with stepladders are also known in the art. Pham, U.S. Pat. No. 5,673,885, discloses a paint tray for a stepladder for storing work materials, tools and a paint bucket that is held onto the ladder by retaining means. Melanson, U.S. Pat. No. 5,613,574, discloses a ladder mounted tool holster and parts tray that removably clamps onto the top step of a stepladder. Katz et. al, U.S. Pat. No. 6,443,260, discloses a stepladder tray pivotally attached to the top cap of a stepladder for supporting tools and the like. Christ et. al, U.S. Pat. No. 5,052,581, discloses a detachable ladder support tray for supporting tools and paint containers.

It is often inconvenient, however, to use a removable tool or paint tray with a stepladder. In some instances, the tray may be difficult to attach or remove from the stepladder. The removable tray and stepladder usually must be stored separately, taking up additional space. Additionally, to move a stepladder from place to place, the tray may need to be removed and carried separately because of weight or awkward transport configuration.

The present invention makes more convenient the use of tool and utility trays with stepladders by incorporating a pivoting utility tray onto the stepladder frame and a locking mechanism for enhanced stability.

SUMMARY OF THE INVENTION

The problems outlined above are addressed and overcome by the present invention. The present invention is directed to a stepladder having a first frame, a second frame, a step, a utility tray and a support arm.

The second frame is pivotally attached to the first frame. The step is operably connected to the first frame and the second frame. The step pivots with respect to at least one of the first frame and the second frame as the first frame is pivoted with respect to the second frame The utility tray is pivotally connected to the second frame. The utility tray includes a top panel and a side panel. The top panel has a first end and a second end. The side panel extends from the top panel along a side of the top panel that extends between the first end and the second end. The side panel has a slot formed therein. The side panel has a detent formed therein. The detent is in communication with the slot.

The support arm has a first end and a second end. The first end of the support arm is pivotally connected to the second frame. The second end of the support arm is slidable with respect to the slot to pivot the utility tray from a raised position to a lowered position.

DETAILED DESCRIPTION OF THE PREFERRED EMBODIMENTS

Figure 2:
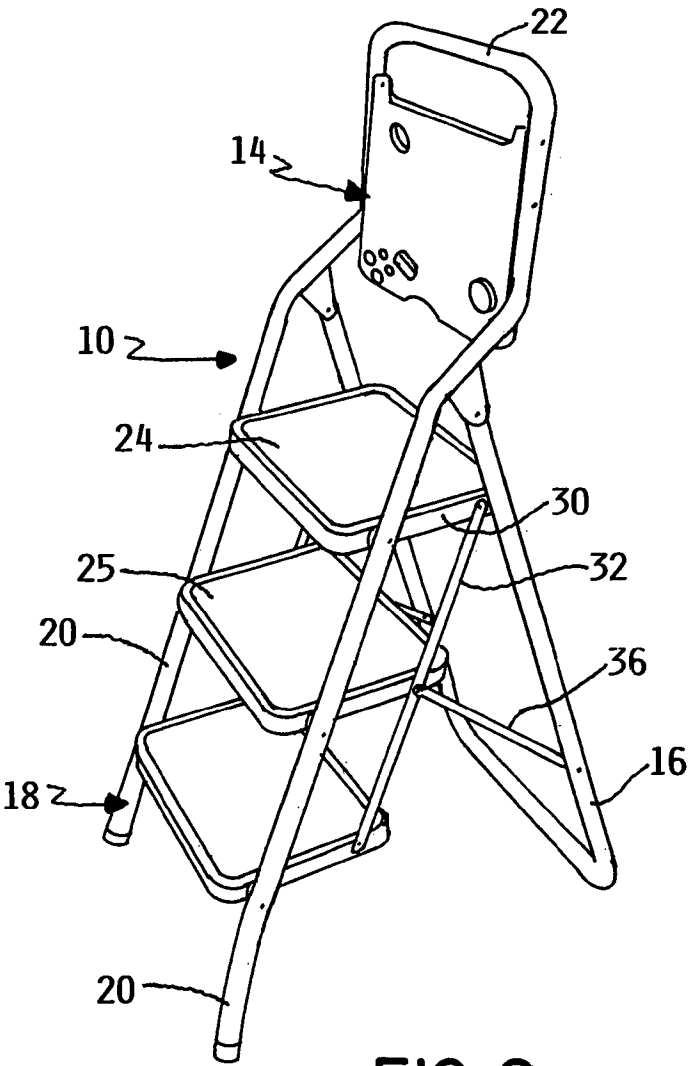
FIG. 2 is a perspective view of the stepladder where the ladder portion is in the open utility tray position and in a storage position.
Figure 1:
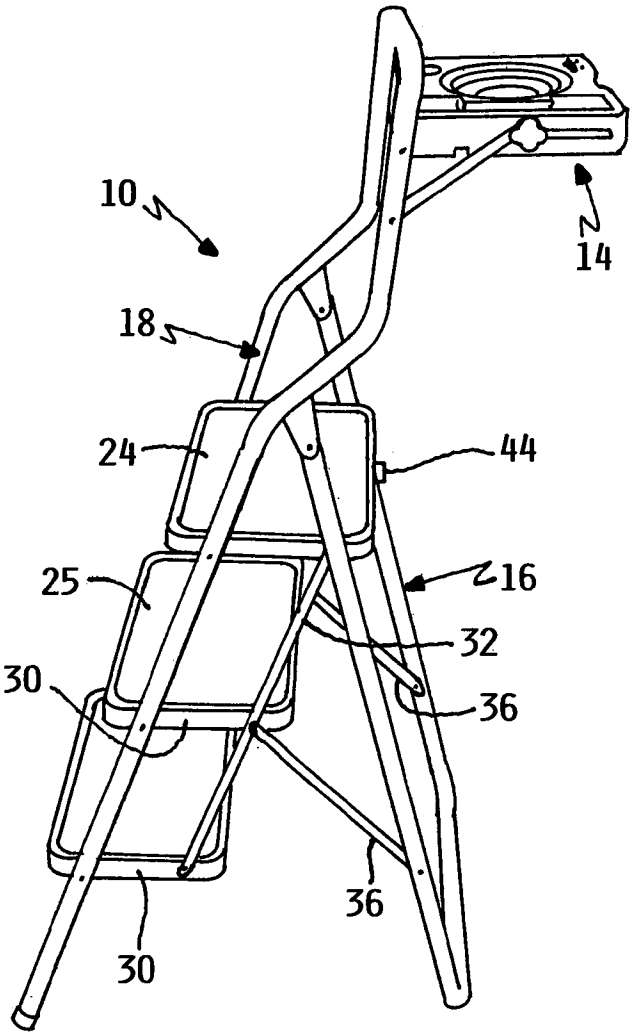
FIG. 1 is a side view of a stepladder with ladder portion and a utility tray according to the present invention where the ladder portion is in an open position and the utility tray is in an extended position.
Figure 3:
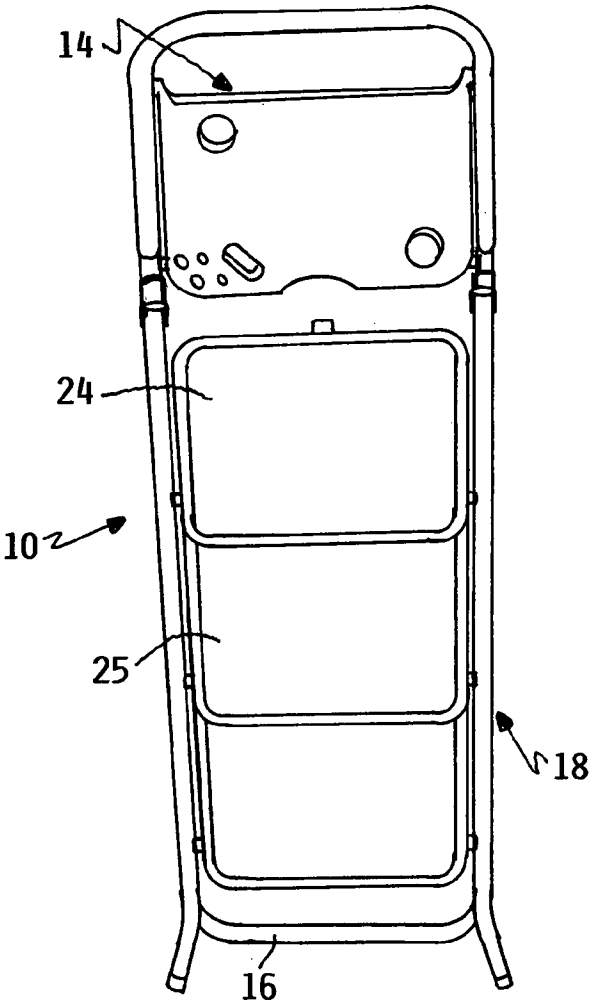
FIG. 3 is a front view of the stepladder where the ladder portion is in a closed position and the utility tray is in the storage position.

The present invention is a stepladder 10 having a ladder portion 12 and a utility tray 14, as illustrated in FIGS. 1–3. The ladder portion 12 includes a first frame 16 that is pivotally attached to second frame 18. The utility tray 14 is pivotable with respect to the ladder portion 12 between a generally horizontal extended position, as illustrated in FIG. 1, and a generally vertical storage position, as illustrated in FIGS. 2 and 3. The utility tray 14 is generally positioned in the frame 18 when the utility tray 14 is in the vertical storage position.

With the utility tray 14 in the extended position, tools and other objects placed on the utility tray 14 may be easily and conveniently reached when the stepladder 10 is in use without interfering with the ability of a person to access the ladder portion 12. Alternatively, when the utility tray 14 is pivoted to the storage position, the stepladder 10 may be placed adjacent a wall or other similar structure.

The second frame 18 has a pair of side posts 20 and an upper handle section 22 that extends between the pair of side posts 20. The upper handle section 22 extends sufficiently above steps on the ladder portion 12 so that the upper handle section 22 may by used to steady a person using the stepladder 10.

A first step 24 is operably connected to the first frame 16 and the second frame 18. The first step 24 pivots between an extended position and a retracted position as the stepladder 10 is moved from an open position, as illustrated in FIGS. 1 and 2, and a closed position, as illustrated in FIG. 3. The first step 24 pivots with respect to at least one of the first frame 16 and the second frame 18 as the first frame 16 is pivoted with respect to the second frame 18. A second step 25 is preferably operably connected to the first frame 16 and the second frame 18. The second step 25 pivots with respect to the second frame 18.

Each of the steps 24, 25 has a pair of opposed side surfaces 30. Proximate a front end of the side surfaces 30, each of the steps 24, 25 is pivotally attached to the side posts 20. Proximate a back end of the side surfaces 30, each of the steps 24, 25 is interconnected with a tie bar 32. This configuration permits each of the steps 24, 25 to pivot in unison.

A support bar (not shown) is provided at an intermediate location on the first frame 16. When the stepladder 10 is in the extended position, the first step 24 rests on the support bar to thereby maintain the first step 24 in a substantially horizontal position.

A linkage bar 36 preferably extends between the first frame 16 and the tie bar 32. The linkage bar 36 is preferably attached to a lower portion of the first frame 16. The linkage bar 36 is preferably attached to an intermediate location on the tie bar 32.

The linkage bar 36 causes the first frame 16 to pivot towards the second frame 18 as the first step 24 is pivoted from a substantially horizontal orientation to a vertical orientation. The linkage bar 36 is preferably pivotally attached to the tie bar 32 proximate to where the tie bar 32 attaches to the second step 25.

A lock mechanism 44 is preferably attached to the first step 24. The lock mechanism 44 is preferably an L shaped piece that is pivotally mounted to the first step 24. An end of the lock mechanism 44 engages the support bar 36 and thereby retains the stepladder 10 in the opened position.

The lock mechanism 44 increases the stability of the stepladder 10 by preventing premature folding from the opened position to the closed position. The lock mechanism 44 operates to easily lock the stepladder 10 in the opened position while providing a valuable safety feature that reduces the likelihood of injury to the stepladder user.

The utility tray 14 has a front end 50 and a rear end 52, as mostly clearly illustrated in FIGS. 4–7. The utility tray 14 is pivotally attached to the second frame 18 proximate the front end 50. A pair of support arms 54 supports the rear end 52. One of the support arms 54 is preferably located on each side panel 55 of the utility tray 14.

Figure 8:
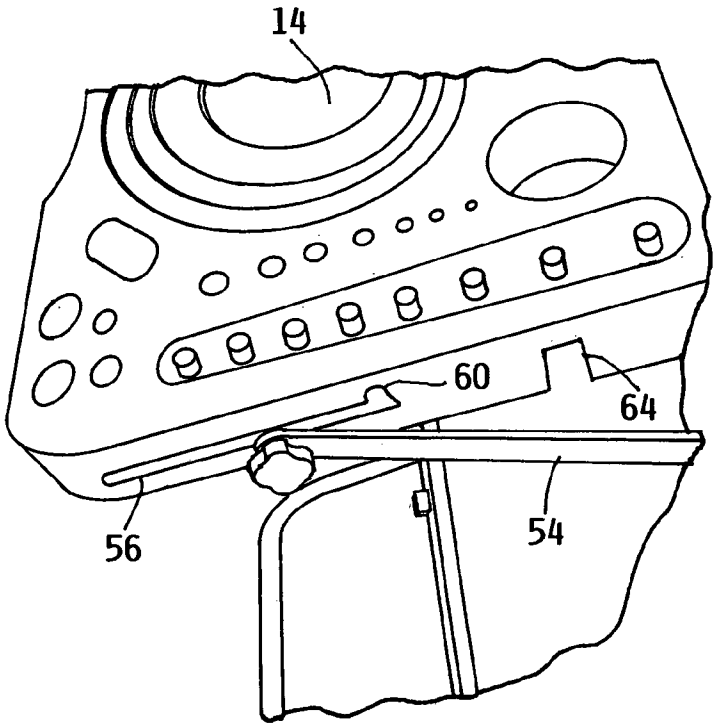
FIG. 8 is an enlarged side view of the slide track where the utility tray is in a partially lowered position.
Figure 6:
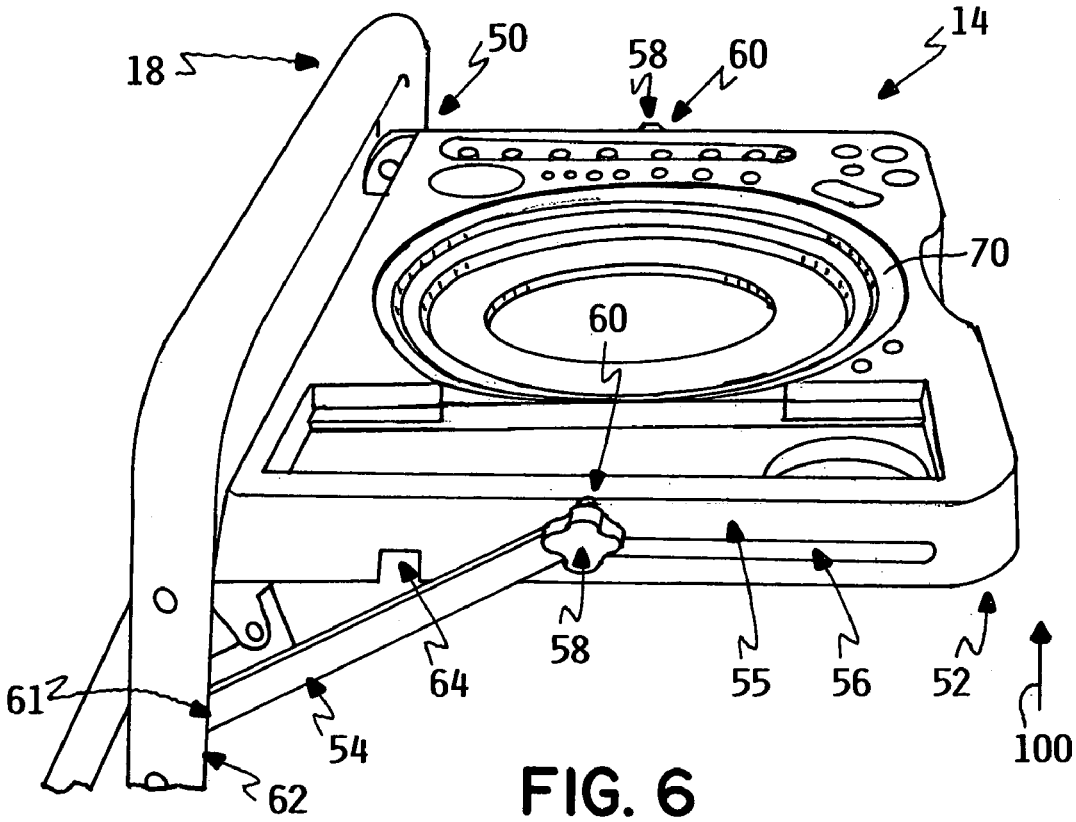
FIG. 6 is an enlarged side view of the utility tray in the extended position.
Figure 7:
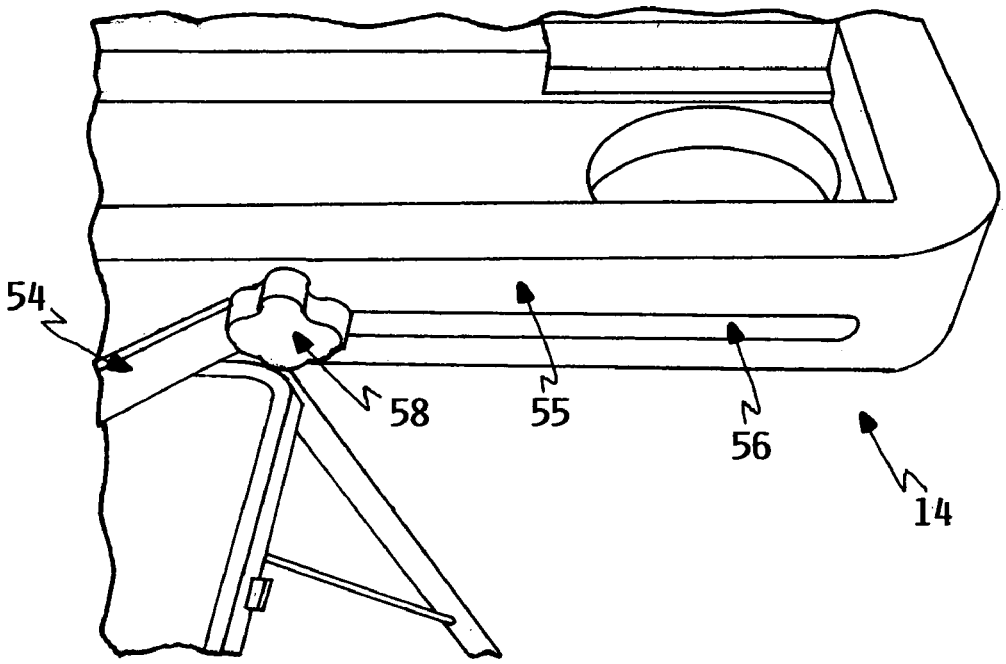
FIG. 7 is an enlarged side view of a slide track on the utility tray.

Each side panel 55 of the utility tray 14 preferably has a slot 56 formed therein, as most clearly illustrated in FIGS. 6–8. The slot 56 is generally oriented from the rear end 52 to the front end 50. Proximate a rear end of the slot 56, a detent 60 is provided. An upper end of the support arms 54 at least partially seats in the detent 60 to retain the utility tray 14 in the extended position. As most clearly illustrated in FIG. 8, the detent 60 is preferably oriented at an angle of less than 90 degrees with respect to the slot 56 so that the detent 60 and the slot 56 form a V shape.

When it is desired to move the utility tray 14 from the extended position to the storage position, the rear end 52 is raised slightly so that the support arms 54 move out of the detent 60. Thereafter, the support arms 54 slide in the slots 56 as the rear end 52 is lowered. Knobs 58 are preferably provided at upper ends of the support arms 54 to facilitate operation of the support arms 54.

A first end 61 is proximate to where the support arms 54 pivotally attach to the second frame 18. An inwardly directed extension 62 is preferably provided proximate the first end 61. The inwardly directed extension 62 is located at a second end 63 of the support arms 54. The inwardly directed extension 62 is designed to snugly sit in a recess 64 formed in a side panel 56. Seating of the inwardly directed extension 62 in the recess 64 facilitates maintaining the utility tray 14 in the storage position.

Figure 4:
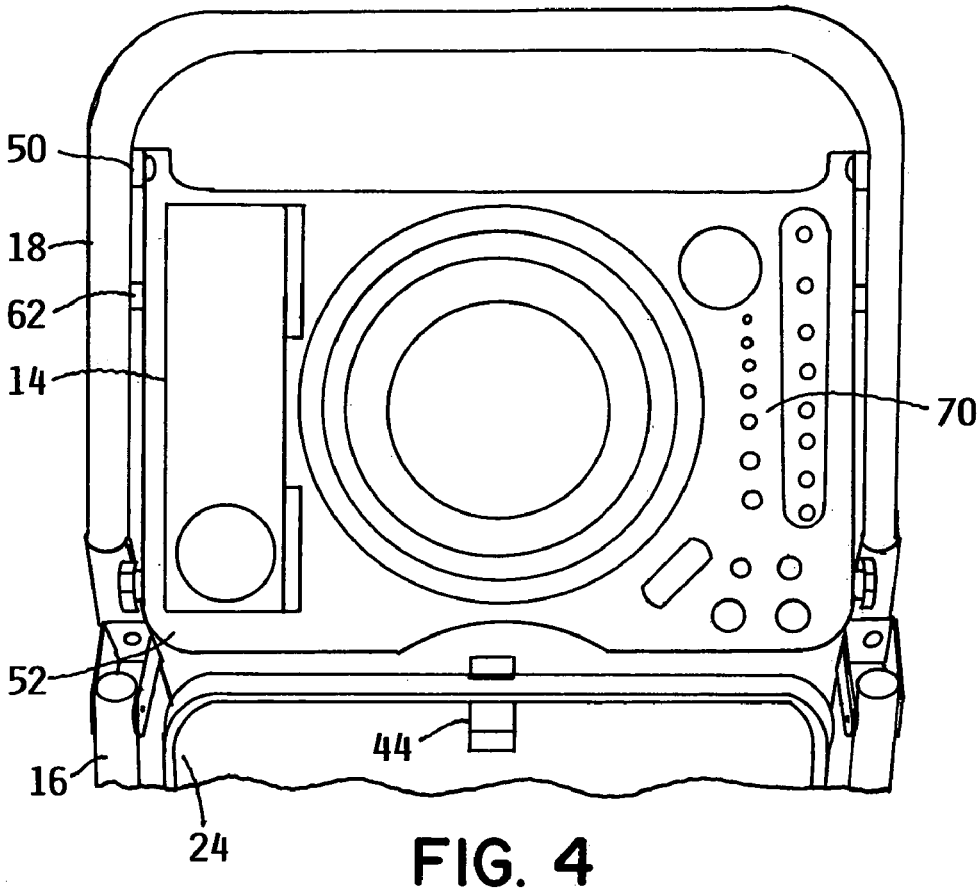
FIG. 4 is an enlarged view of an upper surface of the utility tray.
Figure 5:
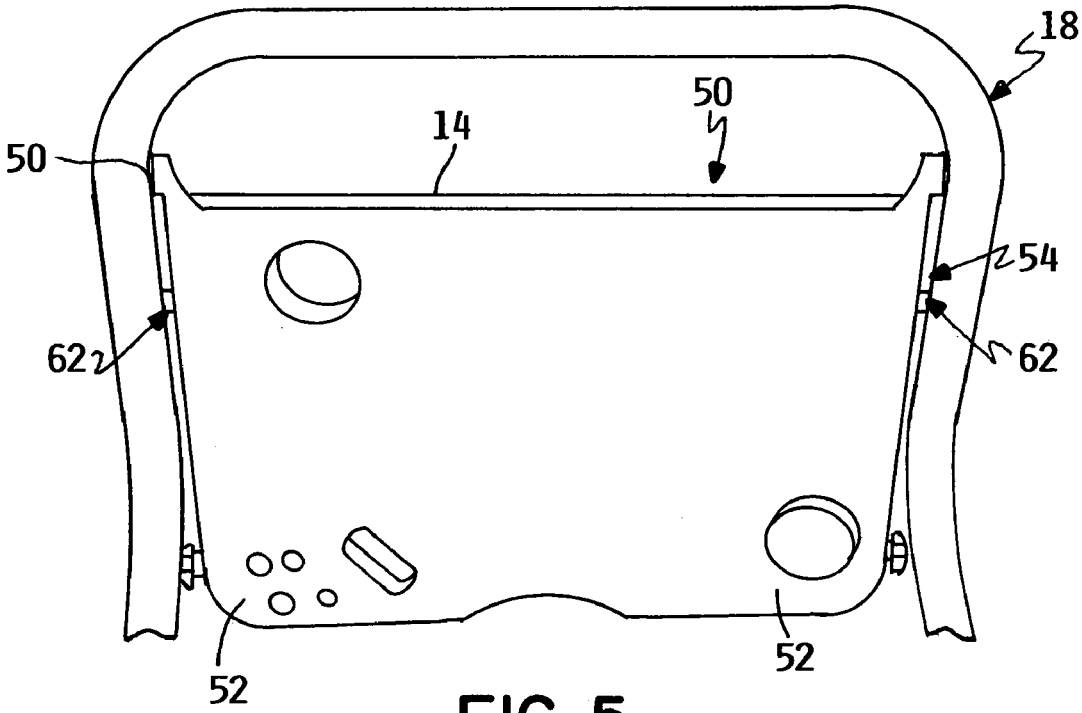
FIG. 5 is an enlarged view of a lower surface of the utility tray.

An upper surface 70 of the utility tray 14 is preferably configured to receive paint cans, tools and other items, as illustrated in FIG. 4. Various sized slots for hand tools may be spaced throughout the utility tray 14. Additionally, a plurality of shallow circular depressions may be integrally formed with the utility tray 14 designed to receive and stabilize a variety of paint can sizes. This structure thereby facilitates maintaining items in a desired location on the utility tray 14.

The ladder portion may be folded into a closed position for transport or storage, as illustrated in FIG. 3. With the utility tray 14 and the ladder 12 portion in the closed position, the stepladder 10 may be readily moved from place to place or stored between uses.

To move the utility tray 14 from its generally horizontal extended position to its upright position, upward pressure 100 is applied to the utility tray 14 to disengage the sliding knobs 58 from the detents 60. Continuous downward pressure on the sliding knobs 58 causes them to slide within the slots 56 and lowers the utility tray 14 until securing knobs 58 are fit securely into the recesses 64.

In an alternative embodiment, extensions may be operably connected to the first frame 16 and the second frame 18.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A stepladder comprising:

a first frame;

a second frame pivotally attached to the first frame;

a step operably connected to the first frame and the second frame, wherein the step pivots with respect to at least one of the first frame and the second frame as the first frame is pivoted with respect to the second frame;

a utility tray pivotally connected to the second frame, wherein the utility tray comprises:

a top panel having a first end and a second end; and a side panel that extends from the top panel along a side of the top panel that extends between the first end and the second end, the side panel has a slot and a detent incommunication with the slot; and a support arm having a first end and a second end, wherein the first end of the support arm is pivotally connected to at least one of the first frame and the second frame and wherein the second end of the support arm is slidable in said slot to pivot the utility tray from a raised position to a lowered position.

2. The stepladder of claim 1, and further comprising a means for moving the utility tray from the raised position to the lowered position, wherein the moving means is operably attached to the support arm.

3. The stepladder of claim 1, wherein the second end of the support arm seats in the detent when the utility tray is in the raised position.

4. The stepladder of claim 1, wherein the side panel has a recess formed therein, wherein the first frame has an extension attached thereto, and wherein the recess has a width that is approximately the same as a width of the extension.

5. The stepladder of claim 4, wherein the extension seats in the recess when the top panel is in the lowered position to retain the top panel in the lowered position.

6. The stepladder of claim 1, wherein the second frame comprises a first side post, a second side post and a handle section that extends between the first side post and the second side post.

7. The stepladder of claim 6, wherein the utility tray is pivotally attached to the first side post and the second side post proximate the handle section.

8. The stepladder of claim 6, wherein the first side post and the second side post each have an upper portion and a lower portion, and wherein the upper portion is oriented at an acute angle with respect to the lower portion.

9. The stepladder of claim 6, wherein a thickness of the utility tray is approximately the same as a distance between the first side post and the second side post so that the utility tray is substantially between the first side post and the second side post when the utility tray is in the lowered position.

10. A stepladder comprising:

a first frame;

a second frame pivotally attached to the first frame, wherein the second frame has an extension attached thereto;

a step operably connected to the first frame and the second frame, wherein the step pivots with respect to the second frame as the first frame is pivoted with respect to the second frame;

a utility tray pivotally connected to the second frame, wherein the utility tray comprises:

a top panel having a first end and a second end; and a side panel that extends from the top panel along a side of the top panel that extends between the first end and the second end, wherein the side panel has a recess formed therein, wherein the recess has a width that is approximately the same as a width of the extension, and wherein the extension seats in the recess when the utility tray is in a lowered position to retain the utility tray in the lowered position, and further comprising a support arm having a first and a second end, wherein the side panel has a slot formed therein, wherein the side panel has a detent formed therein, wherein the detent is in communication with the slot, wherein the first end of the support arm is pivotally connected to the second frame, wherein the second end of the support arm is slidable with respect to the slot to pivot the utility tray from a raised positioned to a lowered position, and wherein the second arm seats in the detent when the utility tray is in the raised position.

11. The stepladder of claim 10, wherein the second frame comprises a first side post, a second side post and a handle section that extends between the first side post and the second side post.

12. The stepladder of claim 11, wherein the utility tray is pivotally attached to the first side post and the second side post proximate the handle section.

13. The stepladder of claim 11, wherein the first side post and the second side post each have an upper portion and a lower portion, and wherein the upper portion is oriented at an acute angle with respect to the lower portion.

14. The stepladder of claim 11, wherein a thickness of the utility tray is approximately the same as a distance between the first side post and the second side post so that the utility tray is substantially between the first side post and the second side post when the utility tray is in the lowered position.

15. A stepladder comprising:

a first frame comprising two side posts;

a second frame comprising two side posts and an upper handle section extending between the two side posts, the second frame is pivotally attached to the first frame and capable of pivoting between an extended position and a storage position;

a step operably connected to the side posts of the first frame and the side posts of the second frame, wherein the step pivots with respect to the second frame as the first frame is pivoted with respect to the second frame between the extended position and the storage position;

a utility tray pivotally connected to the side posts of the second frame between the step and the upper handle, wherein the utility tray is capable of pivoting from an upright position in which the utility tray is disposed substantially parallel to the side posts of the second frame, upward and away from the step to a horizontal extended position, the utility tray comprising two sides, at least one of the side having a slot formed therein and a detent in communication with the slot, and further comprising a support arm having a first and a second end, wherein the first end of the support arm is pivotally connected to the second frame, wherein the second end of the support arm is slidable with respect to the slot to pivot the utility tray from a raised positioned to a lowered position, and wherein the second arm seats in the detent when the utility tray is in the extended position.

16. The stepladder of claim 15, wherein the utility tray in the horizontal extended position is disposed substantially parallel to the surface of the step when the first frame and the second frame are in the extended position.

17. The stepladder of claim 15, wherein a thickness of the utility tray is approximately the same as a thickness of the two side posts of the second frame so that the utility tray is substantially between the two side posts of the second frame when the utility tray is in the upright position.

18. The stepladder of claim 15, wherein the utility tray further comprises an upper surface, a bottom surface, the two sides being parallel to each other and being capable of assuming a position parallel to the two side post of the second frame when the utility tray is in the upright position.

19. The stepladder of claim 18, further comprising at least one extension disposed on the surface of at least one of the two side posts extending from the surface inwardly toward the opposing side post.

20. The stepladder of claim 19, wherein at least one side of the utility trays defines at least one recess in the side.

21. The stepladder of claim 20, wherein the at least one extension communicates with the at least one recess when the utility tray is in the upright position.

22. The stepladder of claim 21, wherein communication of the at least one extension and the at least one recess maintain the utility tray in the upright position.

23. The stepladder of claim 18, wherein the slot is disposed between the upper surface and the bottom surface.

24. The stepladder of claim 23, wherein first slot is substantially parallel to the upper surface.

25. The stepladder of claim 18, wherein the upper surface of the utility tray is configured to receive one or more items and thereby facilitate maintaining the one or more items in a desired location on the upper surface.

26. The stepladder of claim 19, wherein the one or more items are selected from the group consisting of paint cans and tools.

* * * * *

UNITED STATES PATENT AND TRADEMARK OFFICE

CERTIFICATE OF CORRECTION

PATENT NO. : 7,128,187 B2
APPLICATION NO. : 10/390550
DATED : October 31, 2006
INVENTOR(S) : Simpson It is certified that error appears in the above-identified patent and that said Letters Patent is hereby corrected as shown below:

Column 3, Line 41:

Delete "mostly" and insert --most--.

Column 4, Line 49:

Insert a space between "in" and "communication".

Column 5, Line 48:

Delete "positioned" and insert --position--.

Column 6, Line 20:

Delete "side" and insert --sides--.

Column 6, Line 26:

Delete "positioned" and insert --position--.

Column 6, Line 42:

Delete "post" and insert --posts--.

Signed and Sealed this

Tenth Day of July, 2007

JON W. DUDAS
*Director of the United States Patent and Trademark Office*